US011612042B2

(12) United States Patent
Mekenkamp

(10) Patent No.: US 11,612,042 B2
(45) Date of Patent: Mar. 21, 2023

(54) METHOD AND A CONTROLLER FOR CONFIGURING A REPLACEMENT LIGHTING DEVICE IN A LIGHTING SYSTEM

(71) Applicant: SIGNIFY HOLDING B.V., Eindhoven (NL)

(72) Inventor: Gerhardus Engbertus Mekenkamp, Valkenswaard (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/281,733

(22) PCT Filed: Sep. 27, 2019

(86) PCT No.: PCT/EP2019/076133

§ 371 (c)(1),
(2) Date: Mar. 31, 2021

(87) PCT Pub. No.: WO2020/069985

PCT Pub. Date: Apr. 9, 2020

(65) Prior Publication Data

US 2021/0400788 A1 Dec. 23, 2021

(30) Foreign Application Priority Data

Oct. 5, 2018 (EP) ..... 18198861

(51) Int. Cl.
*H05B 47/175* (2020.01)

(52) U.S. Cl.
CPC ..... *H05B 47/175* (2020.01)

(58) Field of Classification Search
CPC ..... H05B 47/175
See application file for complete search history.

(56) References Cited

U.S. PATENT DOCUMENTS 8,878,457 B2 11/2014 Schenk et al.
9,081,265 B2 7/2015 Spaulding et al.
(Continued)

FOREIGN PATENT DOCUMENTS

WO 2013057666 A1 4/2013

*Primary Examiner* — Minh D A

(57) ABSTRACT

A method (400) of configuring a replacement lighting device in a lighting system is disclosed. The method (400) comprises: obtaining (402) a light scene from a memory (106, 108), wherein the light scene is indicative of lighting control settings for a plurality of lighting devices (112, 114, 116) of the lighting system, receiving (404) a signal indicative of an addition of a new lighting device (118) to the lighting system, determining (406) that a first lighting device (116) of the plurality of lighting devices (112, 114, 116) has been removed from the lighting system, obtaining (408) first data indicative of first light rendering capabilities of the first lighting device (116), obtaining (410) second data indicative of second light rendering capabilities of the new lighting device (118), comparing (412) the first light rendering capabilities to the second light rendering capabilities to identify a difference between the first and second light rendering capabilities, and generating (414) an updated light scene, wherein the updated light scene comprises a lighting control setting for the new lighting device (118), wherein the lighting control setting is based on the original light scene and the difference between the first and second light rendering capabilities.

19 Claims, 4 Drawing Sheets

(56) References Cited

U.S. PATENT DOCUMENTS

| | | | | |
|---|---|---|---|---|
| 9,615,434 | B2 | 4/2017 | Vangeel et al. | |
| 2014/0380234 | A1* | 12/2014 | Shim | G06F 3/0488 715/781 |
| 2015/0351196 | A1 | 12/2015 | Usui | |
| 2016/0286624 | A1* | 9/2016 | Patel | G01S 5/16 |
| 2017/0181254 | A1 | 6/2017 | Meitl et al. | |
| 2018/0098201 | A1* | 4/2018 | Torello | G01S 13/84 |
| 2018/0132335 | A1* | 5/2018 | Jonsson | H05B 47/105 |
| 2018/0139818 | A1* | 5/2018 | Coombes | H05B 45/10 |
| 2018/0176521 | A1* | 6/2018 | Laduke | H04N 9/3182 |
| 2018/0235039 | A1* | 8/2018 | Krajnc | H05B 45/20 |
| 2018/0254835 | A1* | 9/2018 | Breuer | H05B 45/10 |

* cited by examiner

400

METHOD AND A CONTROLLER FOR CONFIGURING A REPLACEMENT LIGHTING DEVICE IN A LIGHTING SYSTEM

CROSS-REFERENCE TO PRIOR APPLICATIONS

This application is the U.S. National Phase application under 35 U.S.C. § 371 of International Application No. PCT/EP2019/076133, filed on Sep. 27, 2019, which claims the benefit of European Patent Application No. 18198861.9, filed on Oct. 5, 2018. These applications are hereby incorporated by reference herein.

FIELD OF THE INVENTION

The invention relates to a method of configuring a replacement lighting device in a lighting system. The invention further relates to a computer program product for executing the method. The invention further relates to a controller for configuring a replacement lighting device in a lighting system.

BACKGROUND

Current home and professional lighting systems comprise multiple lighting devices that are connected via a (wireless) network. A user may expand the lighting system by adding new lighting devices. Alternatively, a user may want to replace a lighting device with a new lighting device to upgrade the lighting system. The new lighting device may have new/improved functionality. Replacing a lighting device requires that a user removes the lighting device physically by disconnecting it, and by removing/deleting a virtual counterpart of the lighting device from the software application that is used to control/configure the lighting system. Additionally, the user is required to configure the new lighting device. The new lighting device may, for example, be added to a room by means of the software application, be added to a group of lighting devices, be provided with control rules, etc. This can be rather cumbersome.

U.S. patent application 2017/181254 A1 tries to solve this problem by providing a method for replacing a lighting device in a wireless lighting device network, by identifying a first lighting device, downloading configuration data for the first lighting device, identifying a second (replacement) lighting device using the mobile device, uploading the configuration data to the second lighting device, and updating a configuration database based on identification information for the second lighting device and the configuration data uploaded to the second lighting device. Additionally, a user may later edit the configuration data to manually reconfigure the replaced lighting device.

U.S. Pat. No. 8,878,457 discloses that if a light source fails, e.g. stops to emit light due to an empty battery, breakage, or removal from its original location etc, a second illumination pattern is provided, which is perceived as different when compared to the first illumination pattern as was present when all light sources were functioning. This may be noted by a user operating the lighting system or automatically by the lighting system. If the user operating the system notes this failure, the user may point the remote control towards the area being illuminated by the light sources to measure the "new" illumination pattern. The remote control is used for detecting, subsequent illumination parameters. The remote control communicates the subsequent illumination parameters to the control unit, which determines a new set of control signals for the remaining light sources of the lighting system. The control signals for the light sources may be adapted such that the difference between a further third illumination pattern, resulting from only light from the functioning light sources, is minimized.

SUMMARY OF THE INVENTION

The inventor has realized that the solution of U.S. patent application 2017/181254 A1, i.e. copying the configuration settings of a removed lamp to a newly installed one, may not be sufficient, as it may still require manual configuration of the replacement lighting device. If, for example, the replacement lighting device has additional or different functionalities compared to the old lighting device, the user would still need to manually configure the replacement lighting device. It is therefore an object of the present invention to reduce manual (re)configuration of a replacement lighting device.

According to a first aspect of the present invention, the object is achieved by a method of configuring a replacement lighting device in a lighting system, the method comprising:

obtaining a light scene from a memory, wherein the light scene is indicative of lighting control settings for a plurality of lighting devices of the lighting system, receiving a signal indicative of an addition of a new lighting device to the lighting system, determining that a first lighting device of the plurality of lighting devices has been removed from the lighting system, obtaining first data indicative of first light rendering capabilities of the first lighting device, obtaining second data indicative of second light rendering capabilities of the new lighting device, comparing the first light rendering capabilities to the second light rendering capabilities to identify a difference between the first and second light rendering capabilities, and generating an updated light scene, wherein the updated light scene comprises a lighting control setting for the new lighting device, wherein the lighting control setting is based on the original light scene and the difference between the first and second light rendering capabilities.

Lighting devices of a lighting system are often controlled based on light scenes. Such light scenes describe control instructions for controlling multiple lighting devices of the lighting system according to lighting control settings. When a light scene is activated (for instance by a user, a timer, a predefined routine, etc.), the lighting devices associated with that scene are controlled according to the respective lighting control settings. These lighting control settings may comprise instructions for controlling, for example, the color, brightness, saturation, beam shape and/or beam direction of the respective lighting devices. Not all lighting devices have the same light rendering capabilities. A first (removed) lighting device may, for example, comprise light sources configured to render white light only, while a new lighting device may comprise light sources configured to render colored light. In another example, a first (removed) lighting device may, for example, comprise light sources configured to render light with a first maximum brightness, while a new lighting device may comprise light sources configured to render light with a second (e.g. higher) maximum brightness. When a user installs the new lighting device, it may be desirable that previous light scenes are adjusted based on the capabilities of the new lighting device. After comparing the first light rendering capabilities of the first (old/removed) lighting device with the second light rendering capabilities of the new lighting device, the lighting control setting of the new lighting device in the light scene is updated based on the difference, and also based on the original (previous, unupdated) light scene. In other words, the light scene is adjusted based on the new/different functionality of the new lighting device. The new scene comprises lighting control instructions for the new lighting device and the further lighting devices of the plurality of lighting devices that remain installed in the lighting system. This is beneficial, because it does not require a user to manually remove the first lighting device from the light scene and manually configure the light scene for the new lighting device, thereby reducing the need for manual (re)configuration of a replacement lighting device.

The method may further comprise communicating, via a user interface, the updated light scene to a user, receiving a user input indicative of a confirmation of the updated light scene, and storing the updated light scene in the memory if the confirmation is positive. This is beneficial, because it enables a user to approve the updated light scene (and therewith the lighting control setting for the new lighting device). The updated light scene may be stored (only) when the user has confirmed the updated light scene. The method may further comprise: reverting to the original light scene if the confirmation is negative or generating a secondary updated light scene if the confirmation is negative. A user may disapprove the generated updated light scene and communicate this via the user interface. If so, there may be reverted to the original light scene (i.e. the light scene when the first lighting device was still installed in the lighting system). Alternatively, a secondary updated light scene may be generated. The secondary updated light scene may be generated in a similar way as the (primary) updated light scene.

The lighting control settings of the original light scene may be based on colors in an image. The lighting control settings may, for example, be retrieved from pixel values of areas in a user-selected/user-generated image. The step of generating the update light scene may further include the step of analyzing the image to retrieve a color for the lighting control setting for the new lighting device. The color in the image may be selected based on the light rendering capabilities of the new lighting device. By controlling the new lighting device and the other lighting devices of the lighting system based on colors of the image, a consistent light scene is created.

The step of generating the light scene may further comprise: generating updated lighting control settings for one or more further lighting devices of the lighting system, wherein the updated lighting control settings are based on the original light scene and based on the difference between the first and second light rendering capabilities. The further lighting devices may be lighting devices for which lighting control settings are stored in the light scene. These further lighting devices were already present/installed in the lighting system before the new lighting device was added. It may be beneficial to adjust the lighting control settings for these further lighting devices based on the differentiating functionality of the new lighting device (and, optionally, based on the generated lighting control setting for the new lighting device), because this creates a consistent updated light scene.

The new lighting device may comprise a plurality of individually controllable light sources, and the lighting control setting for the new lighting device may comprise a plurality of lighting control settings for the individually controllable light sources. The new lighting device may, for example, be an LED strip comprising a plurality of individually controllable light sources. Therefore, a plurality of light scenes may be generated/determined for the updated light scene and be assigned to the individually controllable light sources.

The method may further comprise: requesting, via a user interface, a user to confirm that the new lighting device has been added to the lighting system to replace the first lighting device. This is beneficial, because it enables a user to confirm that the new lighting device has replaced the (removed) first lighting device.

The method may further comprise: communicating, via a user interface, a plurality of differences between the first light rendering capabilities and the second light rendering capabilities to a user, and receiving a user input indicative of a selection of at least one of the plurality of differences. The (generation of the) lighting control setting may be further based on the selected difference. If, for example, the new lighting device can emit light with a higher intensity and with more saturated colors compared to the first (removed) lighting device, the user may provide input to indicate how the new lighting device should "behave" in the system. The user may, for example, select the "higher intensity" difference, and the new lighting control setting for the new lighting device may be determined based thereon. This is beneficial, because it enables a user to indicate an intended use of the replacement lamp.

The method may further comprise: communicating, via a user interface, information indicative of a plurality of light scenes comprising one or more updated light scenes and/or the original light scene, receiving user input indicative of a selection of one of the plurality of light scenes, and selecting and storing the updated light scene in the memory based on the selection. This is beneficial, because it enables a user to select which (updated or original) light scene will be applied to the lighting devices when that light scene is activated.

The respective light rendering capabilities (and therewith the differences) may relate to at least one of:

a beam shape, beam size and/or beam direction of a respective lighting device, a number of light sources comprised in a respective lighting device, a minimum brightness of the light output of a respective lighting device, a maximum brightness of the light output of a respective lighting device, and color rendering capabilities of a respective lighting device.

The step of determining that the first lighting device of the plurality of lighting devices has been removed from the lighting system may be based on user input indicative of that the first lighting device has been removed from the lighting system. A user may, for example, provide a user input via a user interface to indicate that the lighting device has been removed from the lighting system/the network. This is beneficial, because it provides additional certainty that the first lighting device has been removed. Alternatively, the determination that the first lighting device has been removed from the lighting system/the network may be based on, for example, that the lighting device can no longer be reached via the network, or based on, for example, a message sent by the first lighting device/a central controller indicative of that the first lighting device malfunctions and no longer functions as originally intended.

The method may further comprise: removing the lighting control setting of the first lighting device from the updated light scene. This is beneficial if the first lighting device will not be re-installed in the lighting system.

The method may further comprise: controlling the plurality of lighting devices according to the updated light scene. The plurality of lighting devices may be controlled according to the updated lighting control setting after the updated light scene has been generated, after it has been stored in the memory, after receiving an approval from the user, after an updated light scene has been selected by a user, etc. This is beneficial, because it enables a user to see the updated light scene. The step of controlling may also occur to preview the updated light scene, whereafter the user may for example confirm the updated light scene, select a different one, or whereafter a secondary updated light scene is generated.

According to a second aspect of the present invention, the object is achieved by a computer program product for a computing device, the computer program product comprising computer program code to perform any one of the above-mentioned methods when the computer program product is run on a processing unit of the computing device.

According to a second aspect of the present invention, the object is achieved by a controller for configuring a replacement lighting device in a lighting system, the controller comprising:

a receiver configured to receive a signal indicative of an addition of a new lighting device to the lighting system, a processor configured to obtain a light scene from a memory, wherein the light scene is indicative of lighting control settings for a plurality of lighting devices of the lighting system, to determine that a first lighting device of the plurality of lighting devices has been removed from the lighting system, to obtain first data indicative of first light rendering capabilities of the first lighting device, to obtain second data indicative of second light rendering capabilities of the new lighting device, to compare the first light rendering capabilities to the second light rendering capabilities to identify a difference between the first and second light rendering capabilities, and to generate an updated light scene, wherein the updated light scene comprises a lighting control setting for the new lighting device, wherein the lighting control setting is based on the original light scene and the difference between the first and second light rendering capabilities.

It should be understood that the computer program product and the controller may have similar and/or identical embodiments and advantages as the above-mentioned methods.

BRIEF DESCRIPTION OF THE DRAWINGS

The above, as well as additional objects, features and advantages of the disclosed systems, devices and methods will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
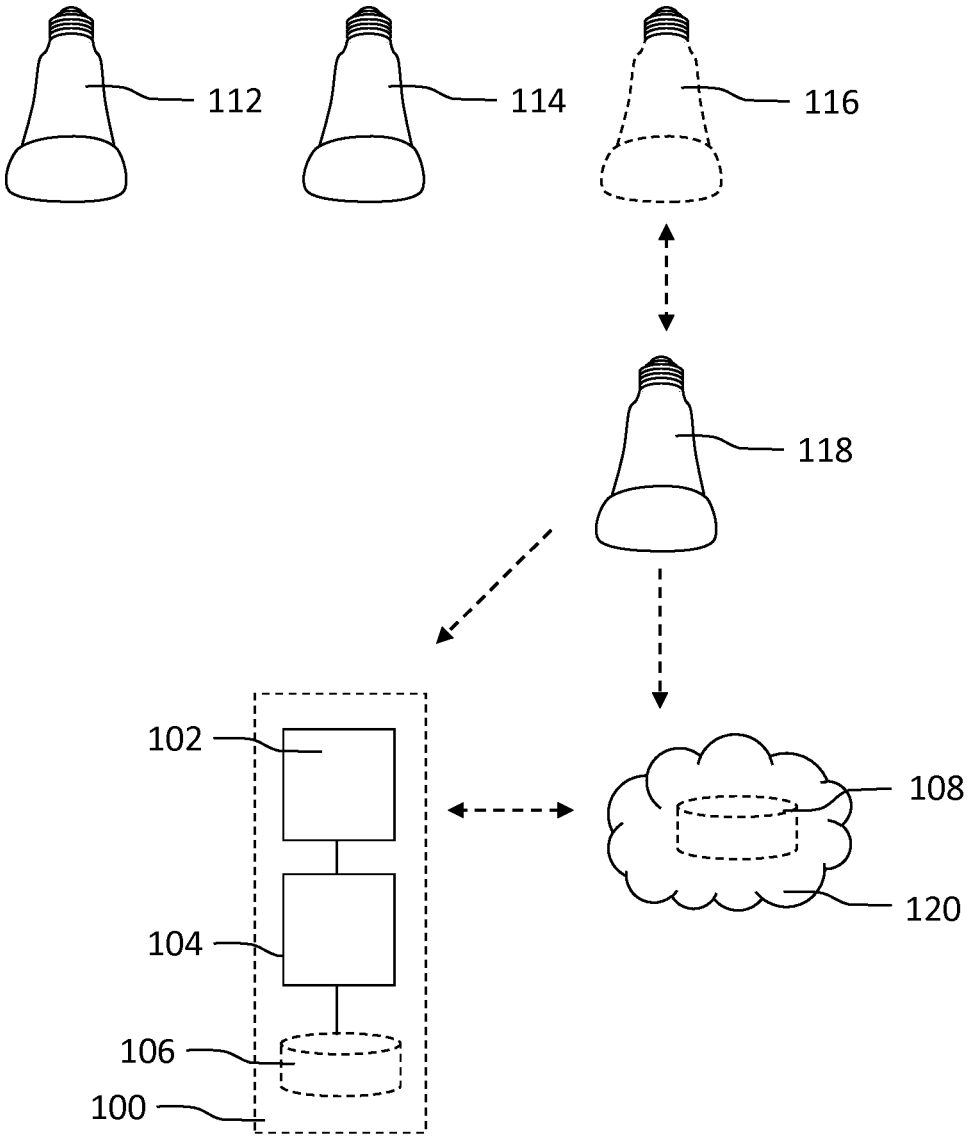
FIG. 1 shows schematically an embodiment of a lighting system comprising a controller for configuring a replacement lighting device in a lighting system.

FIG. 1 shows schematically an embodiment of a lighting system comprising a controller 100 for configuring a replacement lighting device 118 in the lighting system. The controller 100 comprises a receiver 102 configured to receive a signal indicative of an addition of a new lighting device 118 to the lighting system. The signal may be received from the new lighting device 118 directly, or indirectly, for instance via a local network or via the internet. The controller 100 further comprises a processor 104 (e.g. a microcontroller, a microchip, circuitry, etc.) configured to obtain a light scene from a memory 106, 108, wherein the light scene is indicative of lighting control settings for a plurality of lighting devices 112, 114, 116 of the lighting system. The processor 104 is further configured to determine that a first lighting device 116 of the plurality of lighting devices 112, 114, 116 has been removed from the lighting system. The processor 104 is further configured to obtain first data indicative of first light rendering capabilities of the first lighting device 116 and second data indicative of second light rendering capabilities of the new lighting device 118, and to compare the first light rendering capabilities to the second light rendering capabilities to identify a difference between the first and second light rendering capabilities. The processor 104 is further configured to generate an updated light scene for the remaining lighting devices 112, 114 and the new lighting device 118. The updated light scene comprises a new lighting control setting for the new lighting device 118, which lighting control setting is based on the original light scene and the difference between the first and second light rendering capabilities.

The controller 100 may be any type of controller 100 for configuring lighting devices. The controller 100 may, for example, be integrated in a (personal) user device such as a smartphone, a smart watch, a tablet pc, a laptop pc, etc. In embodiments, the controller may be integrated in a central home/office control system. The controller 100 may be further configured to control the lighting devices 112, 114, 116, 118 of the lighting system. The controller 100 may comprise a transceiver for communicating with the lighting devices 112, 114, 116, 118 and/or for example a bridge device of the lighting system, which bridge device in turn may communicate with the lighting devices 112, 114, 116, 118. The transceiver may, for example, be configured to communicate with lighting devices and/or the bridge device via a Wi-Fi, Bluetooth, ZigBee, Ethernet, PLC, etc.

The receiver 102 (which may be a transceiver) is configured to receive the signal indicative of the addition of the new lighting device 118 to the network of the lighting system. The new lighting device 118 may announce itself in the network, whereupon the processor 104 of the controller 100 may allow access to the network, enabling the new lighting device 118 to join the network. The processor 104 may add the new lighting device 118 to the lighting system, and create a virtual counterpart of the new lighting device 118 and store that in a database/memory 106, 108. The database/memory may be configured to store information about which devices are connected/added to the lighting system. Alternatively, a further device may allow the new lighting device 118 access to the network (e.g. a bridge device) and communicate to the controller 100 that the new lighting device 118 has been added to the network.

The processor 104 is further configured to determine that the first lighting device 116 of the plurality of lighting devices 112, 114, 116 has been removed from the lighting system. The processor 104 may determine that the first lighting device 116 has been removed from the network/lighting system based on user input indicative of that the first lighting device 116 has been removed. A user may, for example, provide a user input (e.g. via a user interface, see below) to indicate that the lighting device 116 has been removed from the lighting system/network. Alternatively, the determination that the first lighting device 116 has been removed from the lighting system/network may be based on, for example, that the lighting device can no longer be reached via the network, or based on, for example, a message sent by the first lighting device 116 (or a bridge device). The processor 104 may, based on the determination that the first lighting device 116 has been removed, remove the virtual counterpart of the first lighting device 116 from, for example, the database/memory.

The processor 104 is further configured to obtain a light scene from a memory 106, 108. The memory 106, 108 is configured to store one or more light scenes for controlling multiple lighting devices 112, 114, 116 of the lighting system according to lighting control settings. The memory 106 may be located in the controller 100. Alternatively, the memory 108 may be comprised remotely, for instance in a local device (e.g. a bridge device, a central (home) control system, etc.) or, for example, in a remote device such as a remote server accessible via the internet. When a light scene is activated (for instance by a user, a timer, a predefined routine, etc.), the lighting devices 112, 114, 116 associated with that scene are controlled according to the respective lighting control settings. These lighting control settings may comprise instructions for controlling, for example, the color, brightness, saturation, beam shape and/or beam direction of the respective lighting devices. Table 1 shows an example of a light scene. In this example, lighting devices 112 and 114 comprise light sources configured to emit colored light, and lighting device 116 comprises a light source configured to emit white light only.

TABLE 1

| Light scene | Lighting device 112 | Lighting device 114 | Lighting device 116 |
|---|---|---|---|
| 1 | RGB value [255, 100, 100] | RGB value [255, 0, 0] | On, dim level 50% |
| 2 | RGB value [100, 255, 100] | RGB value [0, 250, 0] | On, dim level 80% |

Light scene 1 may, for example, be a red light scene (e.g. a sunset light scene) comprising a first lighting control setting (RGB value [255,100,100]) for lighting device 112, a second lighting control setting (RGB value [255,0,0]) for lighting device 114 and a third lighting control setting (On, dim level 50%) for lighting device 116. Light scene 2 may, for example, be a green light scene (e.g. a forest light scene) comprising a first lighting control setting (RGB value [100, 255,100]) for lighting device 112, a second lighting control setting (RGB value [0,250,0]) for lighting device 114 and a third lighting control setting (On, dim level 80%) for lighting device 116. Since lighting device 116 is a white-only lighting device, its output may for example be defined by a dim level.

The processor 104 is further configured to obtain first data indicative of first light rendering capabilities of the first lighting device 116 (which has been removed) and to obtain second data indicative of second light rendering capabilities of the new lighting device 118 (which has been added). The first data may be retrieved from a memory 106, 108 storing information about the light rendering capabilities of the first lighting device 116. The second data may be received from the new lighting device 118, directly or indirectly, or be obtained from a database based on an identifier/type of the new lighting device 118. The processor 104 is further configured to compare the first light rendering capabilities to the second light rendering capabilities to identify a difference between the first and second light rendering capabilities.

The light rendering capabilities may, for example relate to a beam shape, beam size and/or beam direction of a respective lighting device. The first lighting device 116 may, for example, have a narrow beam shape, whereas the new lighting device 118 may have a wider beam shape. Additionally or alternatively, the light rendering capabilities may, for example relate to a number of light sources comprised in a respective lighting device. The first lighting device 116 (e.g. an LED bulb) may, for example, have a single light source, whereas the new lighting device 118 (e.g. an LED strip) may have multiple light sources. Additionally or alternatively, the light rendering capabilities may, for example relate to a maximum and/or a minimum brightness (dim level, lumen) of the light output of a respective lighting device. The first lighting device 116 may, for example, have a maximum light output of 600 lumen, whereas the new lighting device 118 may have a maximum light output of 900 lumen. Additionally or alternatively, the light rendering capabilities may, for example relate to color rendering capabilities of a respective lighting device. The first lighting device 116 may, for example, comprise light sources configured to emit white light only, whereas the new lighting device 118 may comprise light sources configured to emit light of different colors.

The processor 104 is further configured to generate an updated light scene. The updated light scene comprises a lighting control setting for the new lighting device 118, which lighting control setting is based on the original light scene and the difference between the first and second light rendering capabilities. Table 2 illustrates an example of an updated version of the light scene of Table 1.

TABLE 2

| Light scene | Lighting device 112 | Lighting device 114 | Lighting device 118 |
|---|---|---|---|
| 1 | RGB value [255, 100, 100] | RGB value [255, 0, 0] | RGB value [255, 0, 0] |
| 2 | RGB value [100, 255, 100] | RGB value [0, 250, 0] | RGB value [50, 253, 50] |

In Table 2, lighting device 116 has been replaced with new lighting device 118. In this example, the processor 104 may determine, based on the comparison of first light rendering capabilities of first lighting device 116 with second light rendering capabilities of new lighting device 118, that new lighting device 118 is capable of rendering colored light (whereas lighting device 116 comprised a light source configured to emit white light only). Based on these differences, the processor may determine lighting control settings for the new lighting device 118 for scenes 1 and 2. The processor 104 may, for instance, determine a lighting control setting for lighting device 118 based on the lighting control setting of another lighting device (e.g. lighting device 114, see Light scene 1). In another example, the processor 104 may interpolate between lighting control settings of other lighting devices of the light scene to determine an "average" color value for the new lighting device 118 (see Light scene 2).

Figure 2:
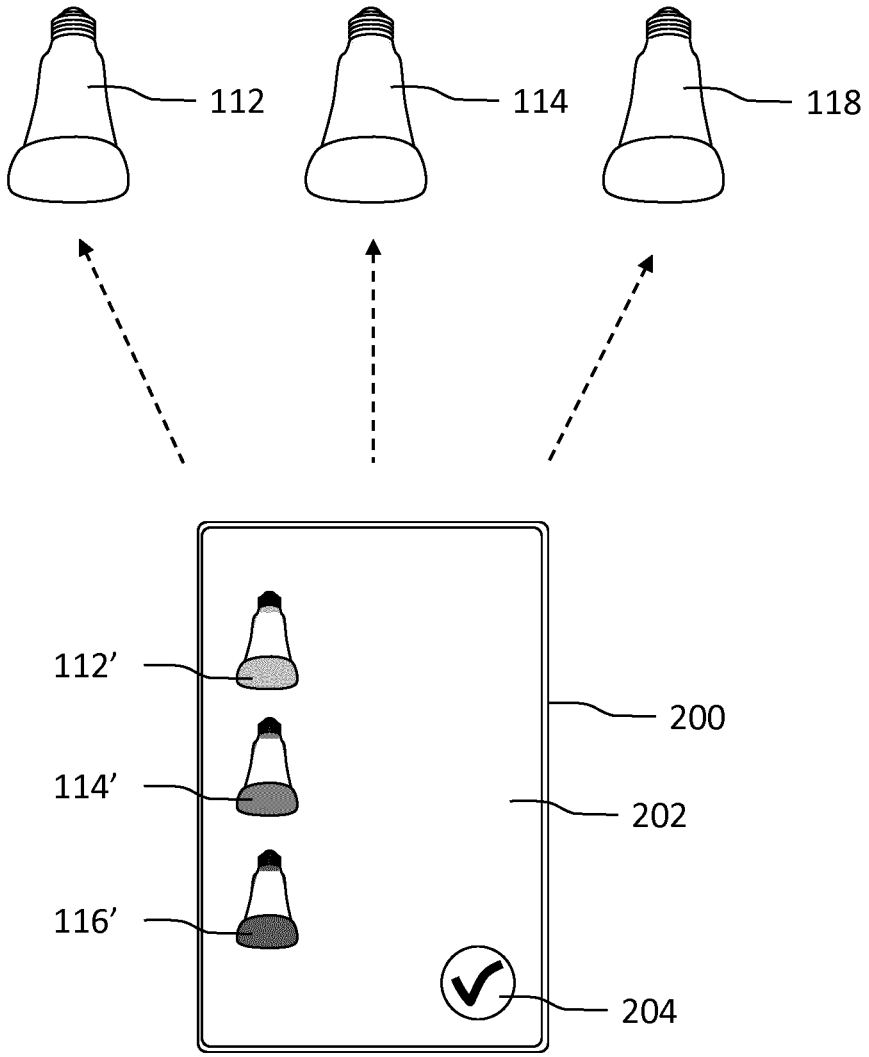
FIG. 2 shows schematically an embodiment of a controller comprising a user interface for configuring a replacement lighting device in a lighting system.

FIG. 2 shows schematically an embodiment of a controller 200 comprising a user interface 202 for configuring a replacement lighting device 118 in a lighting system. In this example, the user interface is a touch screen, but the user interface may be any type of user interface, for example a voice-based or a gesture-based user interface. In this example, the controller 200 is a mobile device (e.g. a smartphone) with a display 202. The processor 104 (not shown in FIG. 2) may be further configured to control the display 202 to communicate the updated light scene to the user. The display 202 may show virtual counterparts 112', 114', 118' of the lighting devices 112, 114, 118 and their respective lighting control settings for a certain light scene. The processor 104 may be further configured to receive a user input indicative of a confirmation of the updated light scene (e.g. via confirmation button 204), and store the updated light scene in the memory 106, 108, such that when the updated light scene is activated the lighting devices 112, 114, 118 associated with that scene are controlled according to their respective lighting control settings. Additionally, (not shown in FIG. 2), a user may disapprove the generated updated light scene, for instance via the touch sensitive display 202 via a disapprove button (not shown). Based on the disapproval, the processor 104 may revert to the original light scene (i.e. the light scene when the first lighting device was still installed in the lighting system) or a secondary updated light scene may be generated, and the above-mentioned process may be repeated.

The processor 104 may be further configured to request, via the user interface, a user to confirm that the new lighting device 118 has been added to the lighting system to replace the first lighting device 116. The processor 104 may, for example, render a button on a touch screen to enable a user to confirm this. Alternatively, the processor 104 may receive a voice confirmation from the user via a microphone. If the confirmation is positive, the processor 104 may generate the updated light scene. Additionally or alternatively, the processor 104 may be further configured to request a user to confirm that the first lighting device 116 has been removed from the lighting system. The user may provide this confirmation via the user interface (e.g. by providing an input via a touch screen, by providing a voice command, etc.).

The processor 104 may be further configured to communicate, via the user interface, one or more differences between the first and second light rendering capabilities to a user. The one or more differences may, for example, be rendered on a display or spoken by a voice assistant. For instance, a first difference may be that the new lighting device 118 comprises light sources configured to emit light with a higher intensity, and a second difference may be that the light sources are configured to provide more saturated colors (as compared to the first lighting device 116). The processor 104 may communicate these differences to the user, whereupon the user may select, via the user interface, one of the differences to indicate an intended use of the new lighting device 118. The user may, for example, select the "more saturated colors" difference. The processor 104 may generate the lighting control setting for the new lighting device 118 based thereon, for instance by creating a colored lighting control setting with a high saturation (rather than a lighting control setting with a high intensity).

The processor 104 may be further configured to communicate, via the user interface, information indicative of a plurality of light scenes comprising one or more updated light scenes and/or the original light scene. The processor 104 may generate a plurality of updated light scenes based on the differences between the first and second light rendering capabilities and the original light scene. The processor 104 may communicate those to a user, whereupon the user may select an updated light scene. This enables a user to select an updated light scene via the user interface (e.g. by pressing a button, providing a voice command, etc.). Alternatively, the processor 104 may communicate the original light scene and one or more updated light settings, enabling the user to select either the original or an updated light scene.

Figure 3:
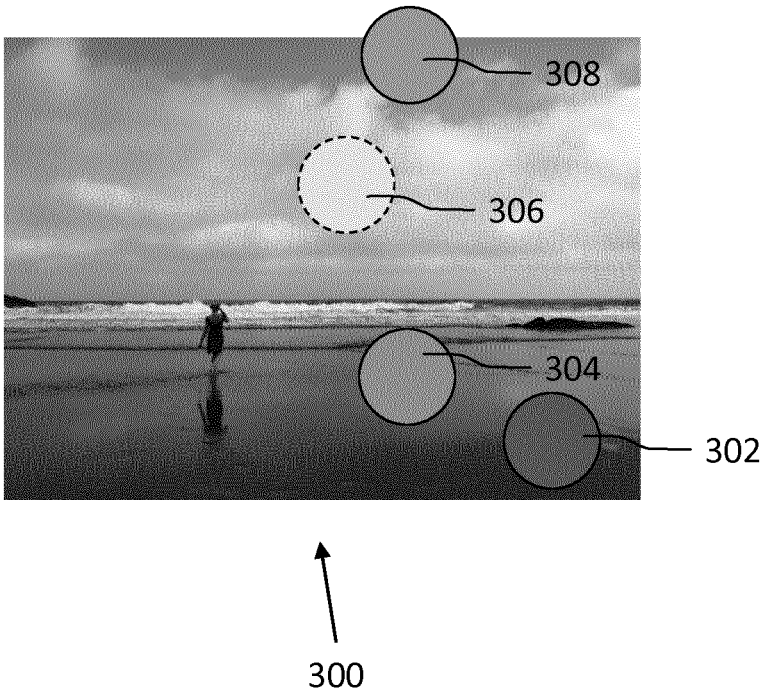
FIG. 3 shows schematically an embodiment of color selection from an image.

The original light scene (i.e. the light scene before it has been updated) may be based on an image. Colors may be retrieved from pixels or pixel areas in an image to determine lighting control settings for lighting devices based thereon. FIG. 3 illustrates three lighting control settings (lighting control setting 302, a dark yellow sand color; lighting control setting 304, a lighter yellow sand color; and lighting control setting 306, a white cloud color) of an original light scene which are based on an image 300. In the original light scene lighting control setting 302 was associated with lighting device 112, lighting control setting 304 was associated with lighting device 114 and lighting control setting 306 was associated with lighting device 116. Lighting device 116 (comprising white only light sources) has been replaced with lighting device 118 (comprising color light sources). Based on the differences between the light rendering capabilities between the first lighting device 116 and new lighting device 118, the processor 104 may determine the lighting control setting 308 in the image 300. Since in this example new lighting device 118 comprises light sources for emitting colored light, the processor 104 may select a color from the image (e.g. a blue sky color), and replace the (white) lighting control setting 306 of the first lighting device 116 with the selected (blue) lighting control setting 308 in the light scene to generate the updated light scene.

The processor 104 may be further configured to generate updated lighting control settings for one or more further, already installed and not removed, lighting devices 112, 114 of the lighting system. The processor 104 may generate these updated lighting control settings based on the original light scene and based on the difference between the first and second light rendering capabilities. If, for example, new lighting device 118 is able to render colors with a higher saturation compared to (removed) first lighting device 116, the light setting for new lighting device 118 may be set by the processor 104 such that it has a higher saturation than the light setting of the first lighting device 116. Additionally, the processor 104 may adjust the (original) light settings of lighting devices 112, 114 such that the saturation of the colors of the light of these lighting devices 112, 114 is also increased. In another example, if new lighting device 118 is able to render white light only at a high intensity (e.g. 1000 lumen) and the (removed) first lighting device 116 could render colors at a lower intensity (e.g. 500 lumen), the light setting for new lighting device 118 may be set by the processor 104 such that it has a higher intensity than the light setting of the first lighting device 116. Additionally, the processor 104 may adjust the (original) light settings of lighting devices 112, 114 such that the saturation of the colors of the light of these lighting devices 112, 114 is also decreased/minimized, and the intensity is increased. As a result, a consistent light scene is created.

The new lighting device 118 may comprise a plurality of individually controllable light sources. The new lighting device 118 may, for example, be a linear lighting device such as an LED strip with individually addressable and controllable LED light sources. The processor 104 may be configured to generate the lighting control setting for the new lighting device 118, such that it comprises a plurality of lighting control settings for the individually controllable light sources. The processor 104 may, for instance, generate a first lighting control setting (e.g. a first color based on the original light scene) for a first set of the individually controllable light sources, and generate a second lighting control setting (e.g. a second, different, color based on the original light scene) for a second set of the individually controllable light sources. Thus, the lighting control setting for the new lighting device 118 may be based on the number of light sources comprised in the new lighting device 118.

The processor 104 may be further configured to control the plurality of lighting devices 112, 114, 118 according to the updated light scene. The plurality of lighting devices 112, 114, 118 may be controlled according to the updated lighting control setting after the updated light scene has been generated, after it has been stored in the memory, after receiving an approval from a user, after an updated light scene has been selected by a user, etc. This enables a user to see the updated light scene. The step of controlling may also occur to preview the updated light scene, whereafter the user may for example confirm the updated light scene, select a different one, or whereafter a secondary updated light scene is generated.

Figure 4:
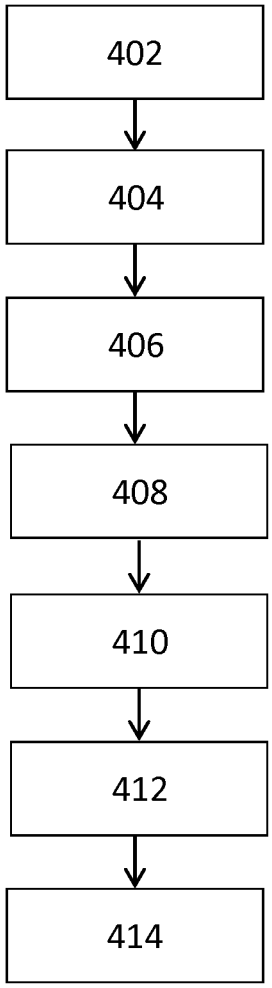
FIG. 4 shows schematically a method of configuring a replacement lighting device in a lighting system.

FIG. 4 illustrates a method 400 of configuring a replacement lighting device in a lighting system, the method 400 comprising:

obtaining 402 a light scene from a memory, wherein the light scene is indicative of lighting control settings for a plurality of lighting devices of the lighting system, receiving 404 a signal indicative of an addition of a new lighting device to the lighting system, determining 406 that a first lighting device of the plurality of lighting devices has been removed from the lighting system, obtaining 408 first data indicative of first light rendering capabilities of the first lighting device, obtaining 410 second data indicative of second light rendering capabilities of the new lighting device, comparing 412 the first light rendering capabilities to the second light rendering capabilities to identify a difference between the first and second light rendering capabilities, generating 414 an updated light scene, wherein the updated light scene comprises a lighting control setting for the new lighting device, wherein the lighting control setting is based on the original light scene and the difference between the first and second light rendering capabilities.

The method 400 may be executed by computer program code of a computer program product when the computer program product is run on a processing unit of a computing device, such as the processor 104 of the controller 100.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors or even the 'cloud'.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A method of configuring a replacement lighting device in a lighting system, the method comprising:

obtaining an original light scene from a memory, wherein the original light scene is indicative of lighting control settings for a plurality of lighting devices of the lighting system, receiving a signal indicative of an addition of a new lighting device to the lighting system, determining that a first lighting device of the plurality of lighting devices has been removed from the lighting system, obtaining first data indicative of first light rendering capabilities of the first lighting device, obtaining second data indicative of second light rendering capabilities of the new lighting device by receiving the second data from the new lighting device or by obtaining the second data from a database based on an identifier or type of the new lighting device, comparing the first light rendering capabilities to the second light rendering capabilities to identify a difference between the first and second light rendering capabilities, and generating an updated light scene, wherein the updated light scene comprises a lighting control setting for the new lighting device, wherein the lighting control setting is based on the original light scene and the difference between the first and second light rendering capabilities.

2. The method of claim 1, further comprising:

communicating, via a user interface, the updated light scene to a user, receiving a user input indicative of a confirmation of the updated light scene, and storing the updated light scene in the memory if the confirmation is positive.

3. The method of claim 2, further comprising the step:

reverting to the original light scene if the confirmation is negative, or generating a secondary updated light scene if the confirmation is negative.

4. The method of claim 1, wherein the lighting control settings of the original light scene are based on colors in an image, and wherein the lighting control setting for the new lighting device is determined based on a color of the image.

5. The method of claim 1, wherein the step of generating the light scene further comprises:

generating updated lighting control settings for one or more-further lighting devices of the plurality of lighting devices of the lighting system, wherein the updated lighting control settings are based on the original light scene and based on the difference between the first and second light rendering capabilities.

6. The method of claim 1, wherein the new lighting device comprises a plurality of individually controllable light sources, and wherein updated light scene is generated such that the lighting control setting for the new lighting device comprises a plurality of lighting control settings for the individually controllable light sources.

7. The method of claim 1, further comprising:

requesting, via a user interface, a user to confirm that the new lighting device has been added to the lighting system to replace the first lighting device.

8. The method of claim 1, further comprising:

communicating, via a user interface, a plurality of differences between the first light rendering capabilities and the second light rendering capabilities to a user, and receiving a user input indicative of a selection of at least one of the plurality of differences, and wherein the lighting control setting is based on the selected difference.

9. The method of claim 1, further comprising:

communicating, via a user interface, information indicative of a plurality of light scenes comprising one or more updated light scenes and/or the original light scene, receiving user input indicative of a selection of one of the plurality of light scenes, and selecting and storing the updated light scene based on the selection.

10. The method of claim 1, wherein the respective light rendering capabilities relate to at least one of:

a beam shape, beam size and/or beam direction of a respective lighting device, a number of light sources comprised in a respective lighting device, a minimum brightness of the light output of a respective lighting device, a maximum brightness of the light output of a respective lighting device, and color rendering capabilities of a respective lighting device.

11. The method of claim 1, wherein the step of determining that the first lighting device of the plurality of lighting devices has been removed from the lighting system is based on user input indicative that the first lighting device has been removed from the lighting system.

12. The method of claim 1, wherein the lighting control setting of the first lighting device is removed from the updated light scene.

13. The method of claim 1, further comprising:

controlling the plurality of lighting devices according to the updated light scene.

14. A non-transitory computer readable medium comprising computer program code to perform the method of claim 1 when the computer program code is executed on a processing unit of a computing device.

15. The method of claim 1, wherein the respective light rendering capabilities relate to at least one of:

a minimum brightness of the light output of a respective lighting device, a maximum brightness of the light output of a respective lighting device, and color rendering capabilities of a respective lighting device.

16. The method of claim 1, wherein the respective light rendering capabilities relate to at least one of a beam shape and/or a beam size of a respective lighting device.

17. The method of claim 1, wherein the respective light rendering capabilities relate to a beam direction of a respective lighting device.

18. A controller for configuring a replacement lighting device in a lighting system, the controller comprising:

a receiver configured to receive a signal indicative of an addition of a new lighting device to the lighting system, a processor configured to obtain an original light scene from a memory, wherein the original light scene is indicative of lighting control settings for a plurality of lighting devices of the lighting system, to determine that a first lighting device of the plurality of lighting devices has been removed from the lighting system, to obtain first data indicative of first light rendering capabilities of the first lighting device, to obtain second data indicative of second light rendering capabilities of the new lighting device by receiving the second data from the new lighting device or by obtaining the second data from a database based on an identifier or type of the new lighting device, to compare the first light rendering capabilities to the second light rendering capabilities to identify a difference between the first and second light rendering capabilities, and to generate an updated light scene, wherein the updated light scene comprises a lighting control setting for the new lighting device, wherein the lighting control setting is based on the original light scene and the difference between the first and second light rendering capabilities.

19. The controller of claim 18, wherein the respective light rendering capabilities relate to at least one of:

a beam shape, beam size and/or beam direction of a respective lighting device, a number of light sources comprised in a respective lighting device, a minimum brightness of the light output of a respective lighting device, a maximum brightness of the light output of a respective lighting device, and color rendering capabilities of a respective lighting device.

* * * * *